US006464338B1

(12) United States Patent
Morita et al.

(10) Patent No.: US 6,464,338 B1
(45) Date of Patent: Oct. 15, 2002

(54) INK JET HEAD WITH SEPARABLE TANK HOLDING MEMBER AND RECORDING UNIT

(75) Inventors: Osamu Morita, Yokosuka; Toshiaki Hirosawa, Hiratsuka; Shogo Kawamura, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/901,107

(22) Filed: Jul. 28, 1997

(30) Foreign Application Priority Data

Jul. 31, 1996 (JP) ..... 8-202246
Jul. 31, 1996 (JP) ..... 8-202250

(51) Int. Cl.[7] ..... B41J 2/14; B41J 2/135
(52) U.S. Cl. ..... 347/49; 347/44
(58) Field of Search ..... 347/49, 50, 85, 347/86, 44, 89, 20, 40

(56) References Cited

U.S. PATENT DOCUMENTS 5,886,721 A * 3/1999 Fujii et al. ..... 347/87
5,923,350 A * 7/1999 Ohnishi et al. ..... 347/50
6,074,049 A * 6/2000 Machler ..... 347/86

FOREIGN PATENT DOCUMENTS

EP 0 639 462 2/1995
EP 0 655 336 5/1995
EP 0 698 497 2/1996
EP 0 699 532 3/1996
EP 0 706 888 4/1996
EP 0 765 757 4/1997
JP 6-031930 2/1994

* cited by examiner

*Primary Examiner*—Hai Pham
(74) *Attorney, Agent, or Firm*—Fitzpatrick, Cella, Harper & Scinto

(57) ABSTRACT

An ink jet recording head capable of separating or coupling ink tanks from or with the head including a recording device substrate having a plurality of recording devices thereon for discharging ink, a wiring device for giving electrical recording signals to the recording device substrate, an ink supply member for supplying ink to the recording device substrate, and a filter member for removing dust particles or the like in ink. This recording unit is provided with all the functions of discharging ink, and coupled with a holder member having only the function of holding and fixing ink tanks. With the structure thus arranged, it becomes unnecessary to connect ink supply paths as in the conventional art, hence eliminating the provision of sealing members. The number of parts is made smaller, while making it possible to carry out inspection of heads only in accordance with the recording units, which significantly contributes to simplifying manufacture and providing highly reliable heads at lower costs.

3 Claims, 19 Drawing Sheets

INK JET HEAD WITH SEPARABLE TANK HOLDING MEMBER AND RECORDING UNIT

BACKGROUND OF THE INVENTION

1. Field of the Invention

The present invention relates to the ink jet recording head of an ink jet recording apparatus. More particularly, the invention relates to an ink jet recording head that scans across a recording medium, such as a paper sheet.

2. Related Background Art

An ink jet recording apparatus is the recording apparatus of the so-called non-impact type recording apparatus, which is capable of recording at high speeds on various kinds of recording media. This apparatus is characterized in that it makes almost no noises at the time of recording. Because of this feature, the ink jet recording apparatus is widely adopted for an apparatus to serve as a printer, a word processor, a facsimile, a copying machine, and others that operate recording system.

As a typical method applicable to the ink jet recording, there is the one that uses electrothermal transducing devices to perform recording on a recording sheet by discharging fine droplets from fine discharge ports. This method is generally structured by an ink jet recording head that forms droplets, and a supply system that supplies ink to this head. The ink jet recording head that uses electrothermal transducing devices is provided with the electrothermal transducing devices in the pressurized chambers, and thermal energy is given to recording liquid by applying electric pulses, which serve as recording signals, to the electrothermal transducing devices. In this way, the pressure of bubbles is utilized for discharging recording droplets at the time of foaming of recording liquid (film boiling) generated by change of phases of the recording liquid.

Further, for an ink jet recording head, there is the one having the system that allows its ink tanks to be separated or does not allow them to be separated from the head.

FIGS. 10A and 10B are views which show the outer appearances of the conventional ink jet recording head of a system that allows its ink tanks to be separated from it. FIG. 10A is a cross-sectional view showing the principal part on the front thereof. FIG. 10B is a side view of such recording head. As shown in FIGS. 10A and 10B, the recording unit 1 comprises a recording device substrate (not shown) fixed to a base plate 3, and an ink supply member 4 connected with the recording device substrate, among some others. The wiring substrate 5 that supplies recording signals to the recording device substrate is adhesively bonded to the base plate 3. Also, a holder member 25 is provided with an ink supply path 7 for supplying ink from the ink tank when it is connected with the ink supply member 4 of the recording unit 1. For the joint portion between the ink supply path 7 and the ink tank, a filter 9 is provided to remove dust particles, bubbles, and the like in ink.

Then, the recording unit 1 and the holder member 25 are fixed by thermally caulking the caulking pin of the holder member 25 to couple it with the base plate of the recording unit 1. At this juncture, the ink supply member 4 of the recording unit 1 and the ink supply path 7 of the holder member 25 are connected by the application of sealing rubber 26 or a bonding agent (silicone sealant, for instance).

However, in accordance with the conventional ink jet recording head described above, it is necessary to connect the ink supply paths when the recording unit and holder member are coupled, which requires the provision of sealing members, adhesive bonding, or the like. In some cases, therefore, the problem may be encountered that air enters the ink relief or ink supply path or bubbles are trapped at the joint between ink supply paths, among some others.

As a result, the number of manufacturing processes is increased, together with the increased costs of parts, as well as additional inspection processes required, among other related operations that lead to producing unfavorable effect on heads costwise, and also, lead to disadvantages with respect to reliability of the head.

SUMMARY OF THE INVENTION

The present invention is designed with a view to solving the problems described above. The objectives of the invention are to simplify the structure of junction between the recording unit and holder member, thus providing an ink jet recording head at lower costs with higher reliability.

In order to achieve such objectives, the ink jet recording head of the present invention is structured by coupling the recording unit, which is provided with all the functions of discharging ink, and the holder member, which is provided only with the function of holding and fixing ink tanks. Unlike the conventional art, the recording unit is provided with all the functions of discharging ink, making it unnecessary to connect ink supply paths or the like. Consequently, there is no need for any provision of sealing members. Also, the inspection of the recording heads can be made only in accordance with the recording unit. The number of parts is made smaller for an easier manufacture. Therefore, not only the reliability of heads become higher, but also, the recording heads are provided at lower costs.

DETAILED DESCRIPTION OF THE PREFERRED EMBODIMENTS

The ink jet recording head of the present invention that enables its ink tank to be separated from or coupled with the head comprises a recording device substrate having a plurality of recording devices arranged thereon for discharging ink; a wiring substrate to apply electrical recording signals to the recording device substrate from the outside; an ink supply member that holds and fixes the recording device substrate and wiring substrate, and supplies ink to the recording device substrate; and a filter member to remove dust particles and the like in ink. This ink jet recording head is characterized in that it is structured by the recording unit having all the functions of discharging ink therefor, which is coupled with the holder member having only the function of holding and fixing ink tanks.

Further, the recording unit and the holder member are fixed by means of screws or by the application of bonding agent.

Further, the recording unit is provided with a part of fixing unit that holds and fixes each of the ink tanks.

Further, the holder member is provided with apertures for positioning ink tanks, apertures for holding and fixing ink tanks, apertures for reading the ink remains in the ink tanks optically, and apertures for reading the ink remains visually by eyesight.

EMBODIMENTS

Hereinafter, with reference to the accompanying drawings, the description will be made of the embodiments in accordance with the present invention.

EMBODIMENT 1

Figure 1:
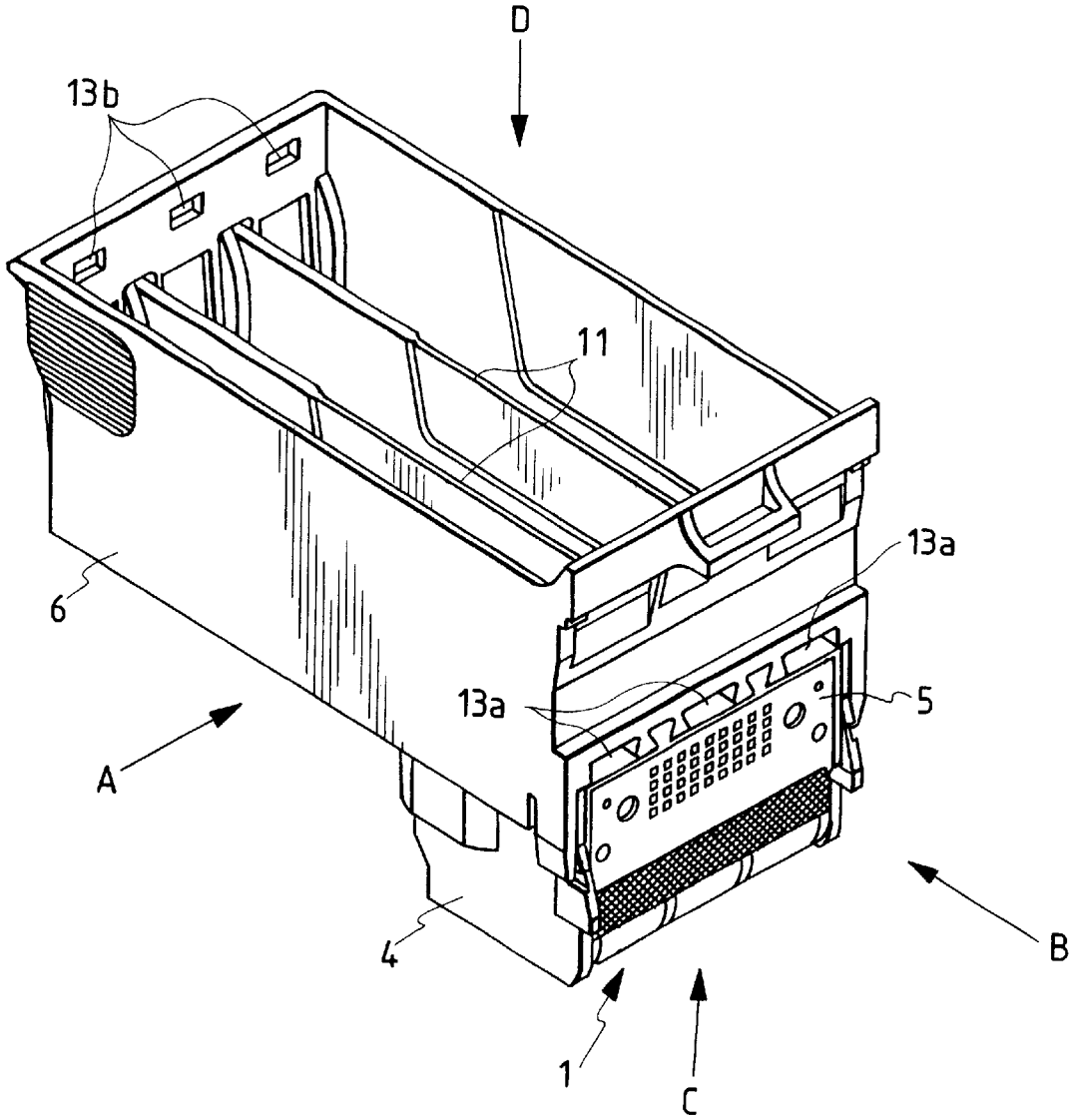
FIG. 1 is a perspective view which shows an ink jet recording head in accordance with a first embodiment of the present invention.
Figure 2:
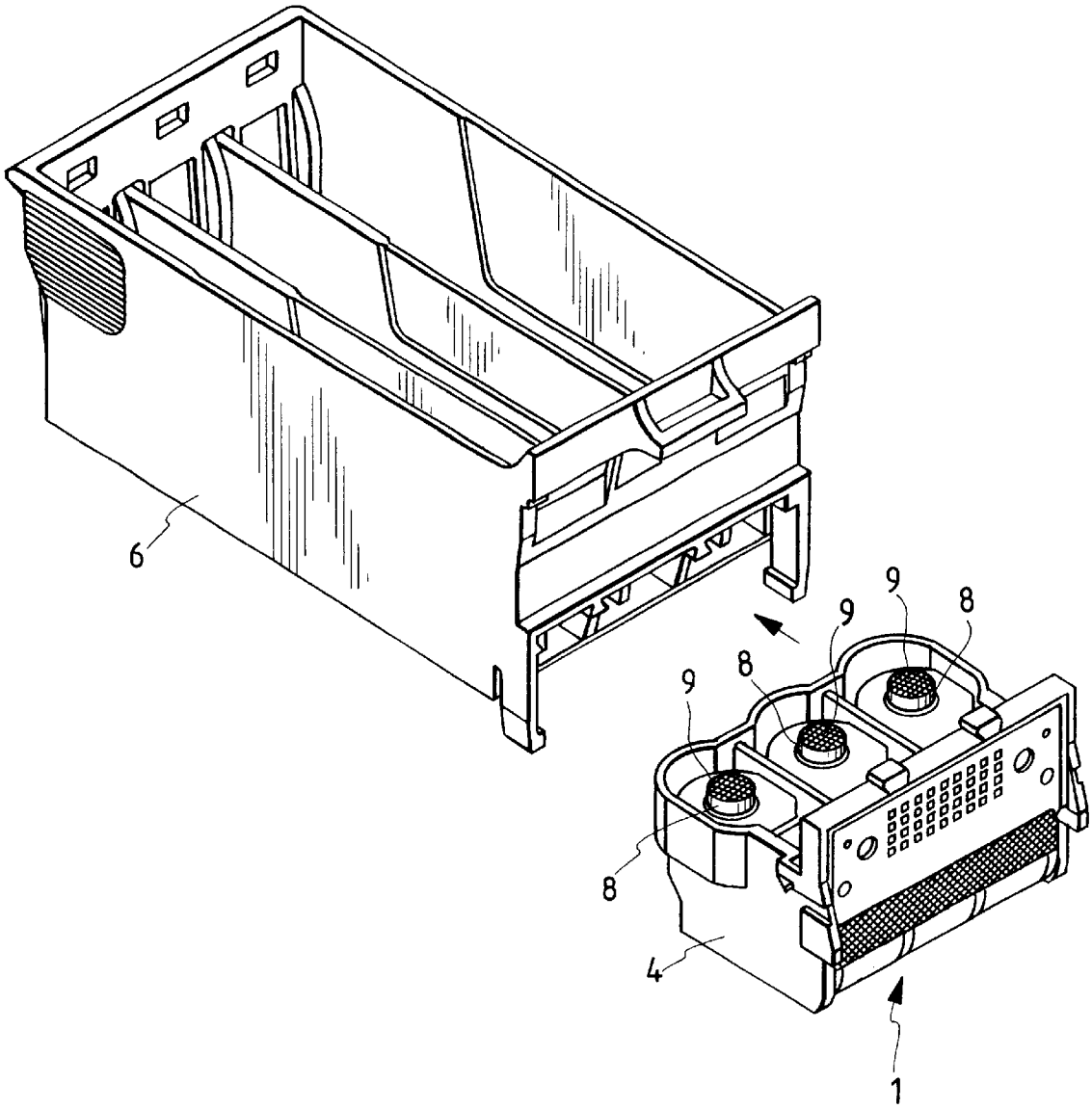
FIG. 2 is an exploded view which shows the ink jet recording head represented in FIG. 1.
Figure 3D:
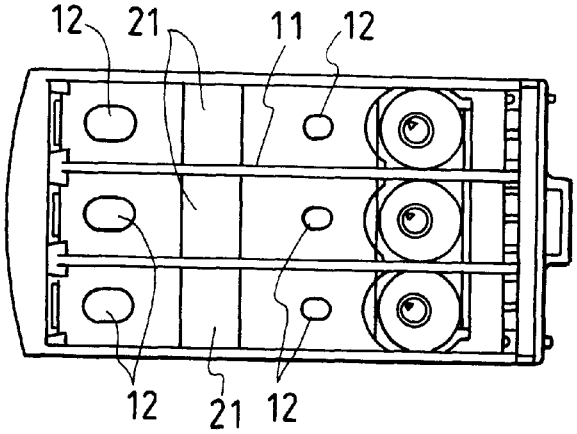
FIGS. 3A, 3B, 3C and 3D are views which illustrate the ink jet recording head represented in FIG. 1, observed in the directions indicated by arrows A to D in FIG. 1, respectively.
Figure 3A:
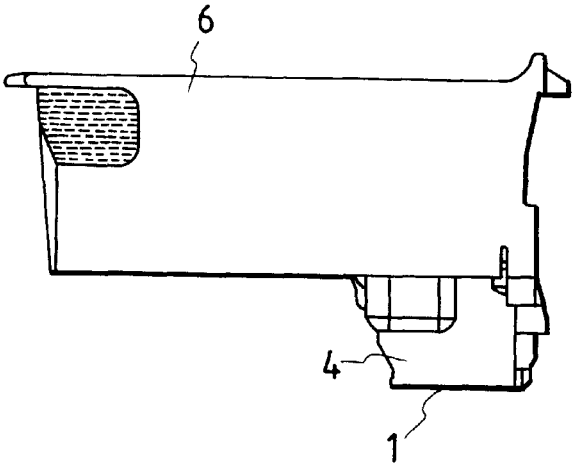
Figure 3B:
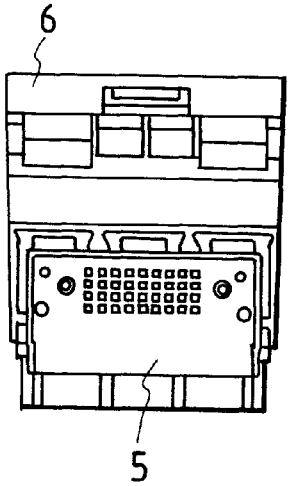
Figure 3C:
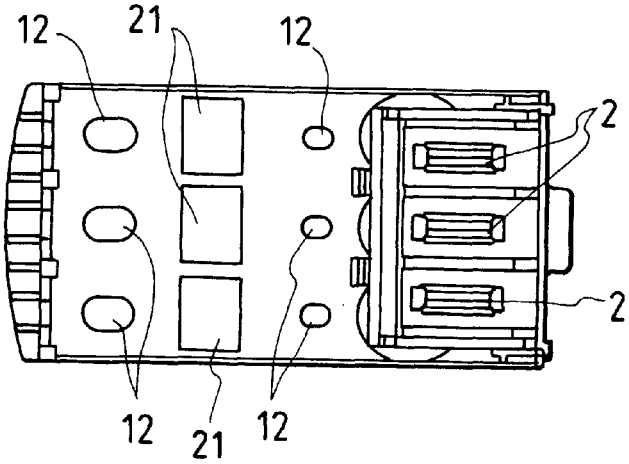

FIG. 1 is a perspective view showing an ink jet recording head in accordance with a first embodiment of the present invention. FIG. 2 is an exploded view of the ink jet recording head shown in FIG. 1. FIGS. 3A to 3D are views of the head, observed in the directions indicated by arrows A to D in FIG. 1.

Figure 4B:
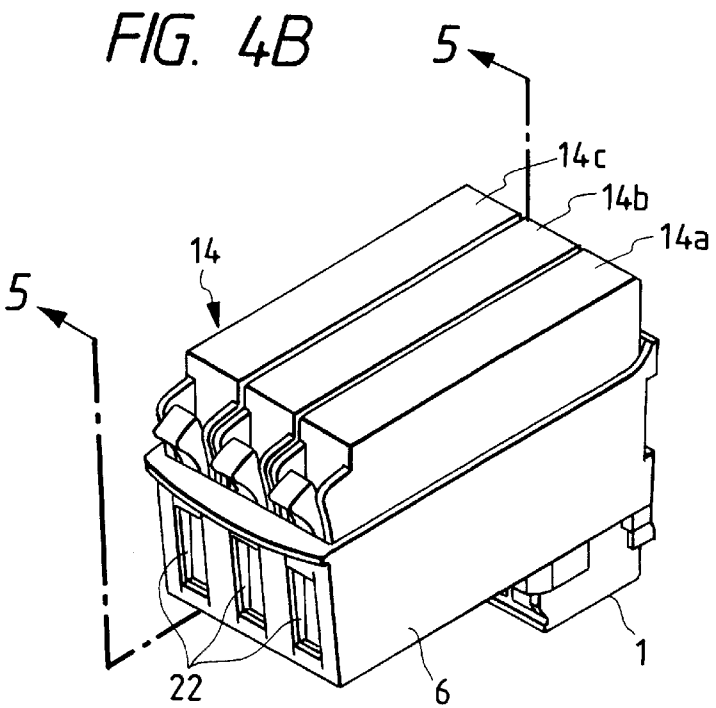
FIGS. 4A and 4B are perspective views which illustrate the states where an ink tank is mounted on the ink jet recording head of the first embodiment.
Figure 4A:
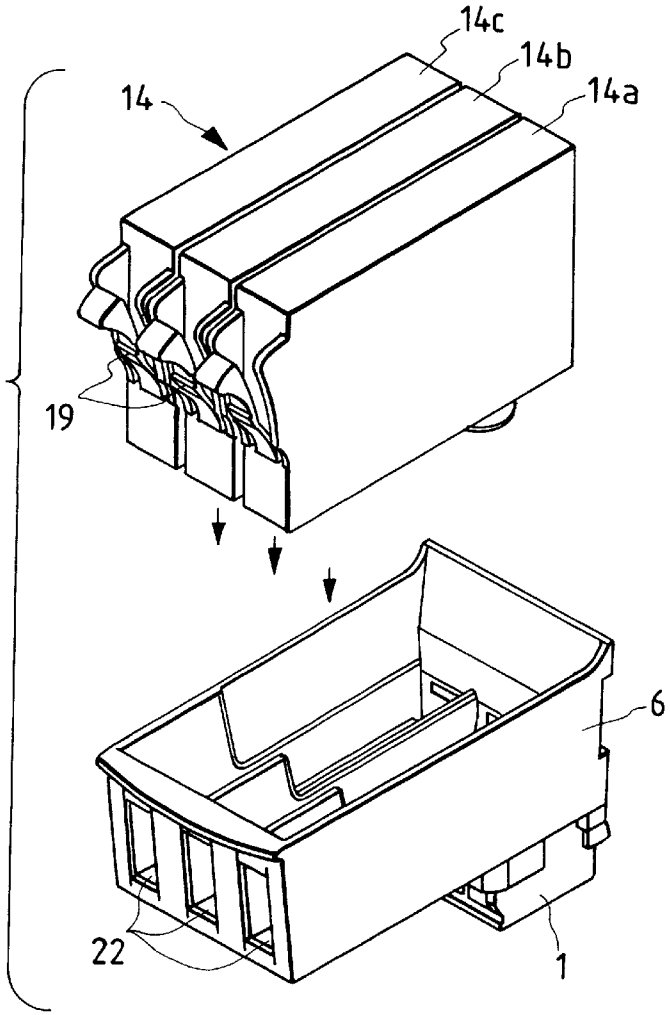
Figure 5:
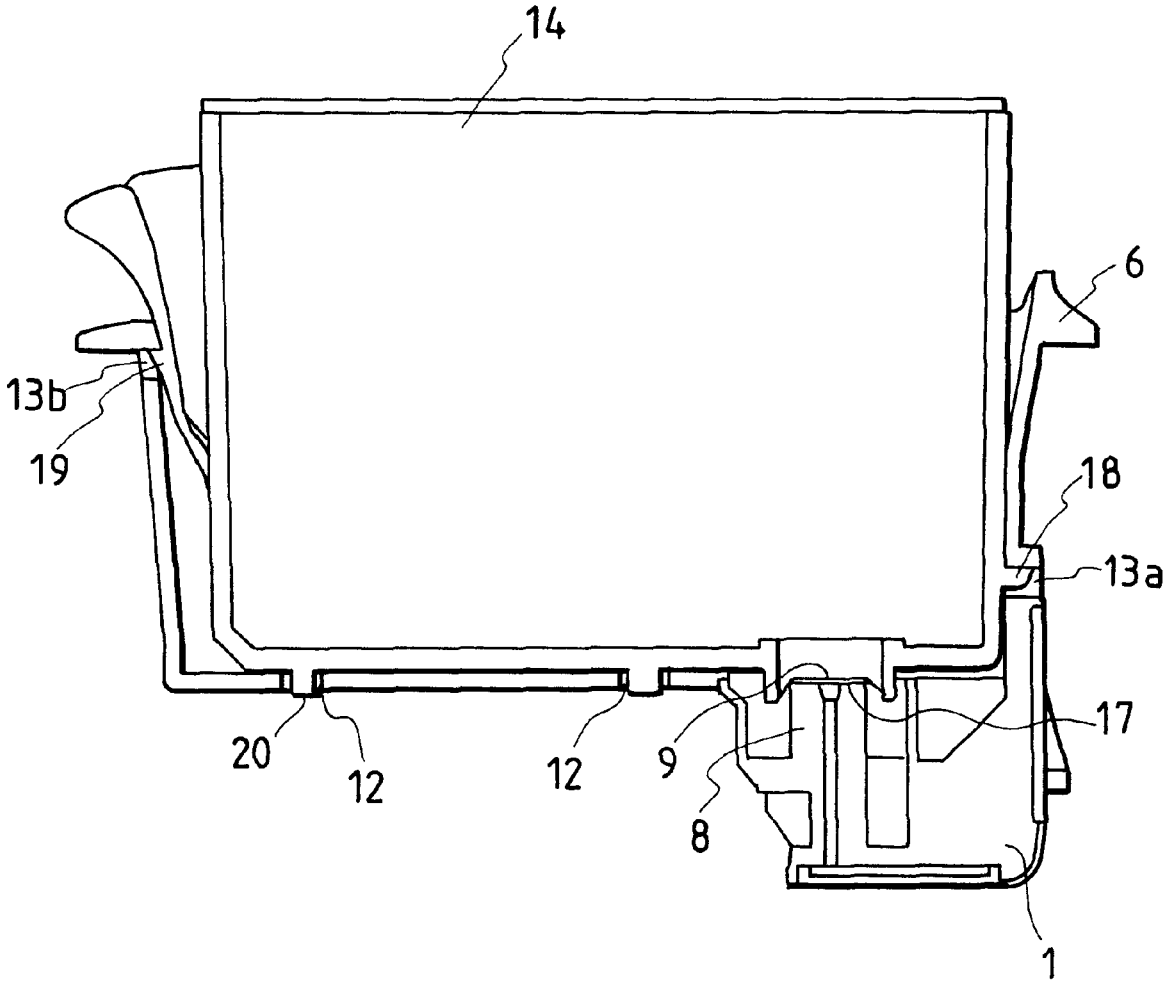
FIG. 5 is a cross-sectional view which shows the ink jet recording head, taken along line 5—5 in FIG. 4B.
Figure 6D:
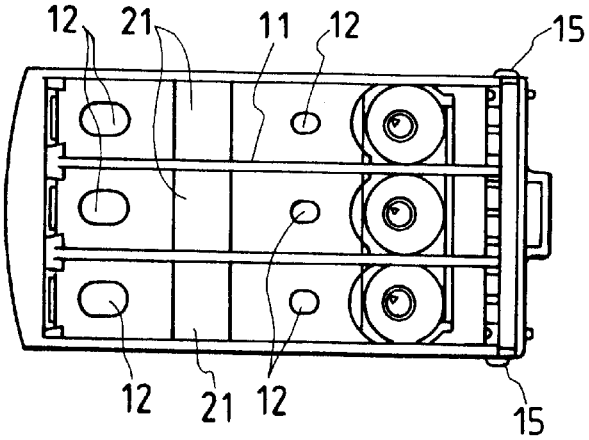
FIGS. 6A, 6B, 6C and 6D are views which illustrate the outer appearance of an ink jet recording head in accordance with a second embodiment of the present invention.
Figure 6A:
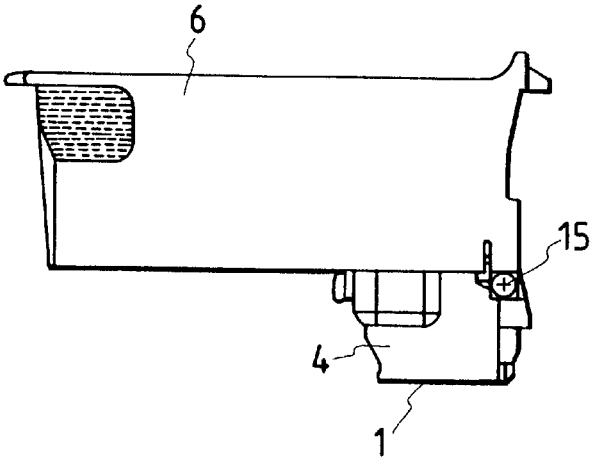
Figure 6B:
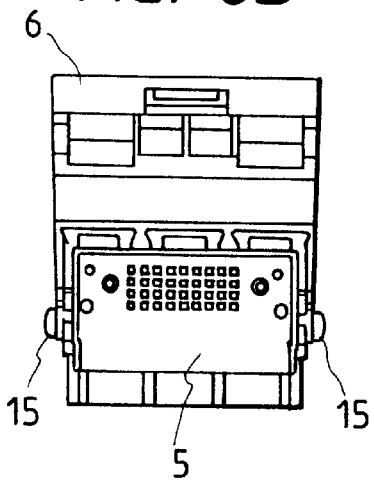
Figure 6C:
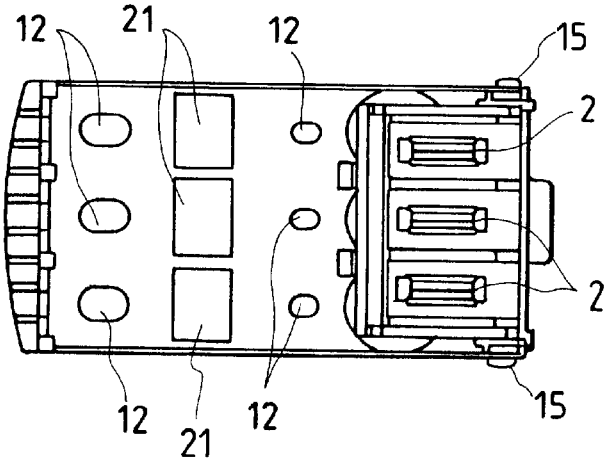
Figure 7D:
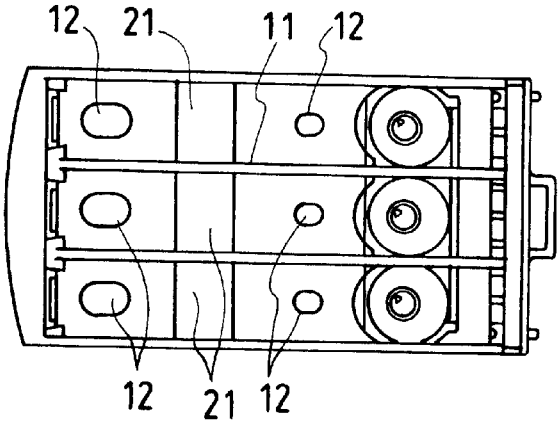
FIGS. 7A, 7B, 7C and 7D are views which illustrate the outer appearance of another ink jet recording head in accordance with a second embodiment of the present invention.
Figure 7A:
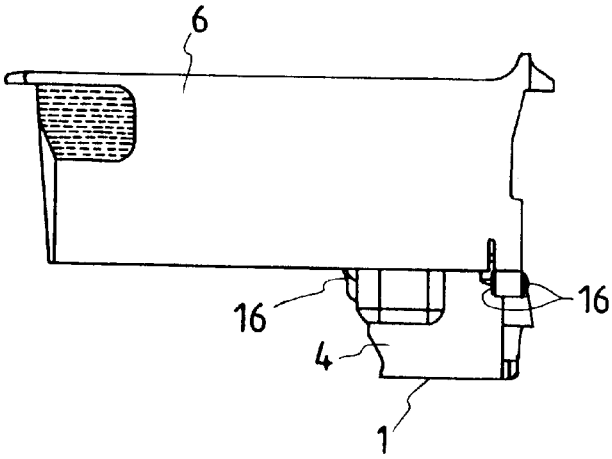
Figure 7B:
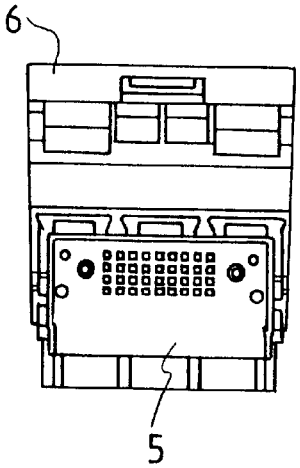
Figure 7C:
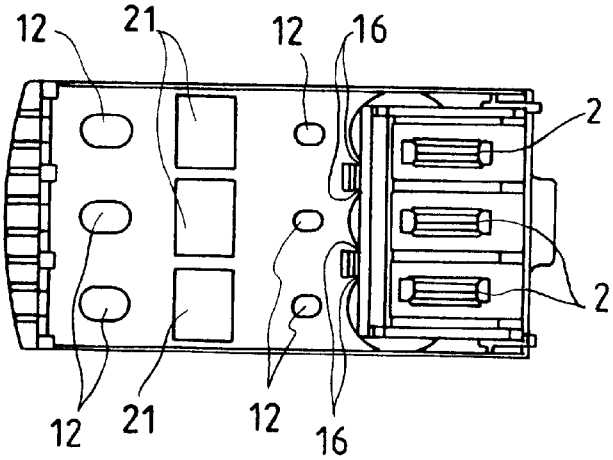

FIG. 4A is a perspective view showing the state before the ink tank is mounted on the ink jet head. FIG. 4B is also a perspective view showing the state after the ink tank is mounted on the head. FIG. 5 is a cross-sectional view taken along line 5—5 in FIG. 4B.

Now, in FIGS. 3A to 3D, a reference numeral 2 designates a recording device substrate having a plurality of recording devices being arranged thereon; 5, a wiring substrate having signals lines provided therefor to give recording signals to the recording device substrate 2; and 4, an ink supply member to supply ink to the recording device substrate 2. Both the recording device substrate 2 and the wiring substrate 5 are held and fixed to the ink supply member 4. Further, as shown in FIG. 2, the ink supply opening 8 of the ink supply member 4 is provided with a filter 9 to remove and trap dust particles and bubbles in ink.

With the structure thus arranged, the recording unit 1 is formed. Ink is supplied from the ink supply opening 8 of the recording unit 1. Recording signals are given to the wiring substrate 5 from outside. Thus, ink jet recording is performed. In other words, all the functions of discharging ink are incorporated in this recording unit 1.

In FIG. 1, a reference numeral 6 designates the holder member having the function of holding and fixing ink tanks. The holder member 6 is provided only with ink tank fixing holes 13*a* and 13*b* and partition walls 11 between each of the ink tanks, serving as the fixing unit that holds and fixes the ink tanks, and ink tank positioning holes (apertures) 12, apertures 21 for detecting the ink remains in the ink tanks optically as shown in FIGS. 3A to 3D, and apertures 22 for reading the ink remains in the ink tanks visually by eyesight (see FIGS. 4A and 4B). In other words, the holder member 6 has only the functions of coupling it with the recording unit 1 in order to hold and fix the ink tanks, and the function of detecting ink remains.

Now, in conjunction with FIGS. 4A, 4B and 5, the description will be made of the mounting of ink tanks on the holder member 6 with which the recording unit 1 has been coupled. In this respect, three tanks 14*a*, 14*b*, and 14*c* are adopted. However, the number of ink tanks is not necessarily limited. Any numbers thereof may be adoptable. When the ink tanks 14 are inserted into the holder member 6, the ink tank fixing ribs 18 and 19 arranged on the sides, and the ink tank positioning knobs 20 arranged on the bottom of the ink tanks engage with the ink tank fixing holes 13*a* and 13*b*, and the ink tank positioning holes 12 arranged on the holder member 6, respectively, thus fixing the ink tanks 14. At this juncture, the surface of the ink supply opening 17 of the ink tanks 14 and the surface of the filter 9 arranged for the ink supply opening 8 of the recording unit 1 are positioned precisely.

The first embodiment of the present invention is characterized in that the ink jet head is structured by coupling together the recording unit 1 which is provided with all the functions of discharging ink, and the holder member 6 which is provided only with the function of holding and fixing ink tanks.

Therefore, in accordance with the present embodiment, when coupling the recording unit 1 with the holder member 6, there is no need for any joints between ink supply paths or the like as in the conventional art, because the recording unit 1 is provided with all the functions of discharging ink, which makes it unnecessary to arrange sealing members. Also, the inspection of recording head is possible only in accordance with the recording unit. The number of parts becomes smaller for an easier manufacture accordingly. As a result, recording heads can be provided at lower costs with higher reliability. In addition, by changing the configuration of the holder member 6, it may be possible to provide ink jet recording heads corresponding to various sizes of ink tanks 14.

EMBODIMENT 2

FIGS. 6A to 6D and FIGS. 7A to 7D are views showing the outer appearance of an ink jet recording head in accordance with a second embodiment of the present invention.

In FIGS. 6A to 6D and FIGS. 7A to 7D, each of the reference marks is the same as each of those applied to the first embodiment shown in FIGS. 3A to 3D. Therefore, the description thereof will be omitted. What differs in the present embodiment from the first embodiment is that the recording unit 1 and the holder member 6 are coupled and fixed by means of screws 15 (see FIGS. 6A to 6D) or by the application of bonding agent 16 (see FIGS. 7A to 7D).

The ink jet recording head should be prevented from being broken even when the recording head falls off onto a floor or the like by mistake. Particularly, it is necessary to prevent the recording unit 1 and the holder member 6 from being separated in such a case.

However, when the capacity of each ink tank is large or when the numbers of ink tanks are many, shock is considerably strong if such recording head falls off onto a floor or the like with ink tanks being mounted on it. Therefore, as described above, the engagement between the recording unit 1 and the holder member 6 is arranged by means of screws 15 and/or by the application of bonding agent 16 so as to make the mechanical strength of the coupling portion stronger for them.

EMBODIMENT 3

Figure 8A:
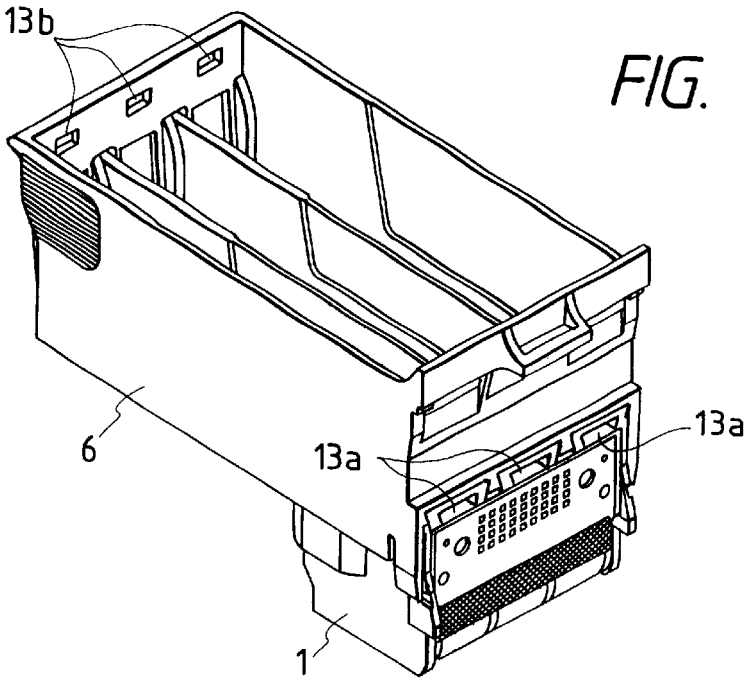
FIGS. 8A and 8B are perspective views which illustrate an ink jet recording head in accordance with a third embodiment of the present invention.
Figure 8B:
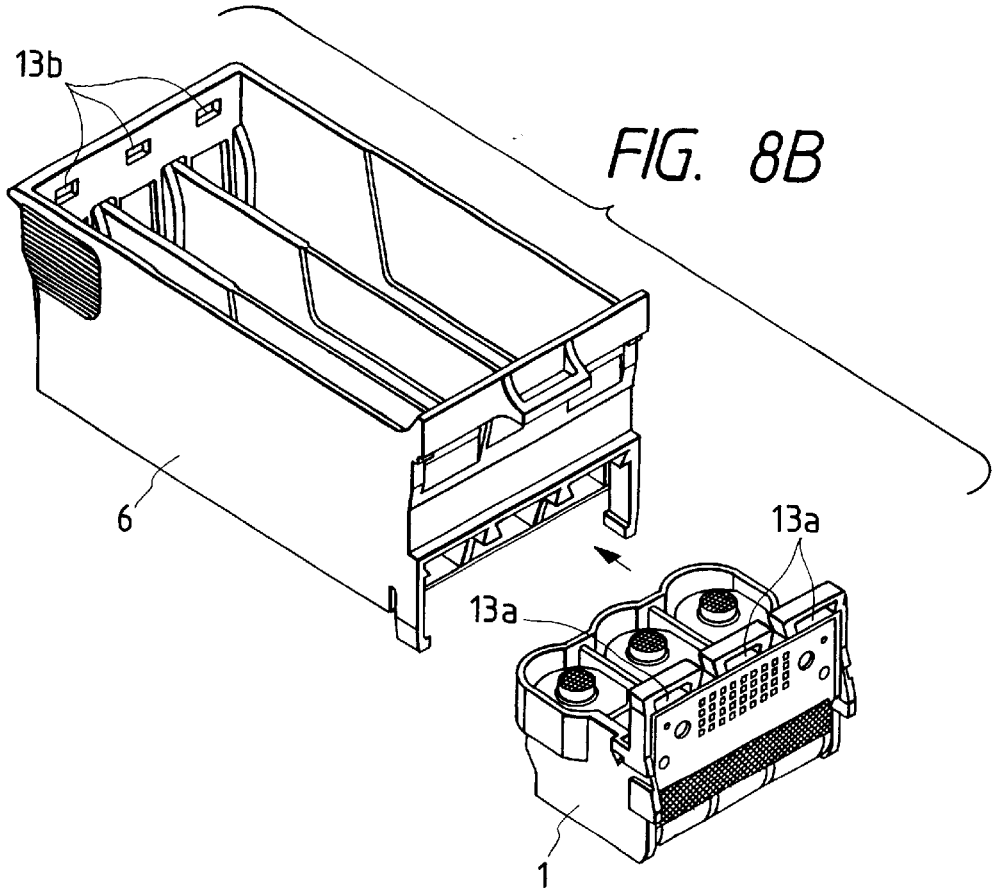

FIGS. 8A and 8B show an ink jet recording head in accordance with a third embodiment of the present invention; FIG. 8A is a perspective view showing the ink jet recording head; and FIG. 8B is an exploded perspective view thereof.

Figure 9:
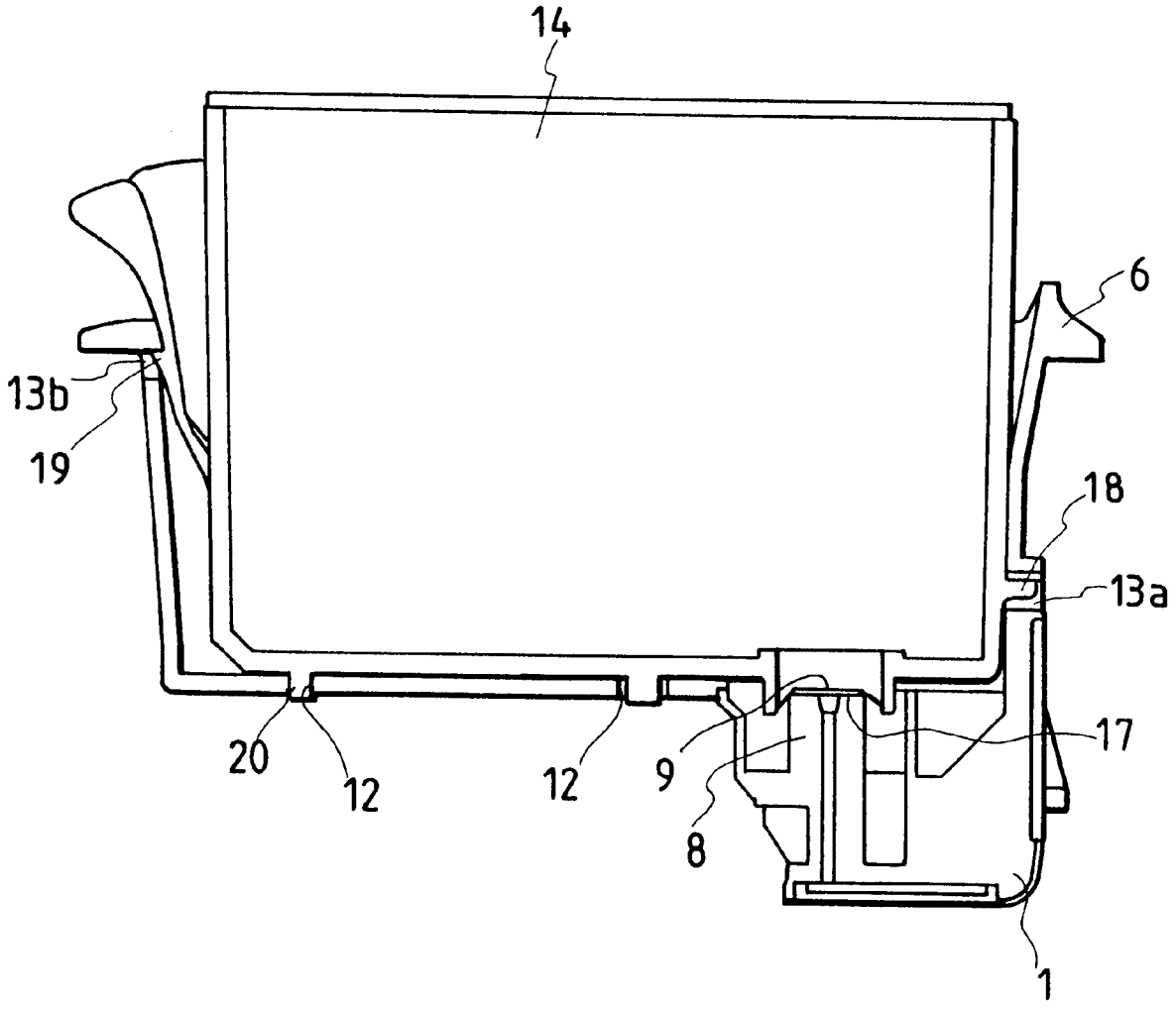
FIG. 9 is a cross-sectional view which shows the ink jet recording head of the third embodiment.
Figure 10B:
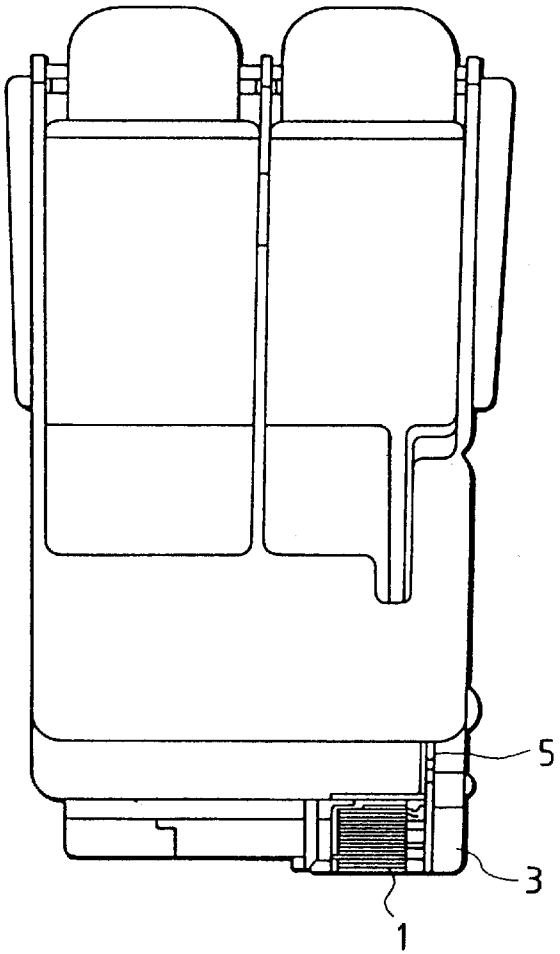
PRIOR ART FIG. 10B
FIGS. 10A and 10B are cross-sectional views which illustrate the principal part of the conventional ink jet recording head.
Figure 10A:
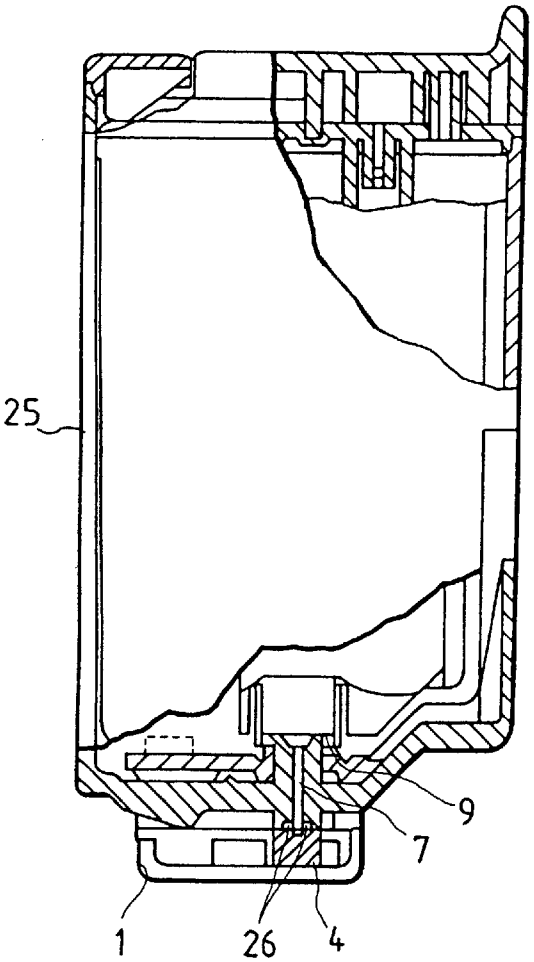
PRIOR ART FIG. 10A

FIG. 9 is a cross-sectional view showing the state where the ink tank is mounted on the ink jet recording head of the third embodiment.

In FIGS. 8A, 8B and FIG. 9, each of the reference marks is the same as each of those applied to the first embodiment shown in FIGS. 1, 2 and 5. Therefore, the description thereof will be omitted. What differs in the present embodiment from the first embodiment is that the recording unit 1 is provided with ink tank fixing holes 13 to hold and fix ink tanks 14.

As shown in FIG. 9, when the ink tanks 14 are mounted on the holder member 6, the positioning precision between the surface of the ink supply opening 17 of the ink tanks 14 and the surface of the filter 9 provided for the ink supply opening 8 of the recording unit 1 is most important with respect to the ink supply. However, if all the portions that regulate the position of the ink tanks 14 are provided only for the holder member 6 as in the first embodiment, it tends to lower the positioning precision between the surface of the ink supply opening 17 and the surface of the filter 9 of the ink supply opening 8 due to the accumulated errors of the coupling play between the holder member 6 and the recording unit 1 and the dimensional errors of the holder member 6 and the recording unit 1. Here, therefore, the ink tank fixing holes 13*a* are arranged for the recording unit 1 to hold and fix the ink tanks 14 by allowing them to engage with the ink tank fixing ribs 18 arranged on the side nearer to the surface of the ink supply opening 17 of the ink tank 14. In this way, it is made possible to improve the positioning precision between the surface of the ink supply opening 17 of the ink tanks 14 and the surface of the filter 9 of the ink supply opening 8 of the recording unit 1.

EMBODIMENT 4

Now, the description will be made of a preferable mode in which the ink tanks are mounted on the ink jet head cartridge described earlier.

The ink tanks described in accordance with the first embodiment are fixed when the ink tank fixing ribs 18, 19, and 20 engage with the holder. With reference to FIGS. 18A to 18C and FIGS. 19A to 19C, the description will be made of the state of the ink tank being mounted on the holder.

In FIGS. 18A to 18C and FIGS. 19A to 19C, it is usually practiced that when the ink tank 14 enters the holder 6, the ink tank fixing rib 18 is at first fitted into the first hole 13*a*. In this state, the ink tank is pressed into the holder. Then, the movable lever is caused to bend inward, thus allowing the ink tank fixing rib 19 to enter the second hole 13*b*. In this way, the ink tank 14 is mounted on and fixed to the ink jet head.

However, with the structure described above, there is a possibility that the filter portion is damaged depending on the directions in which the ink tank is inserted.

Figure 20A:
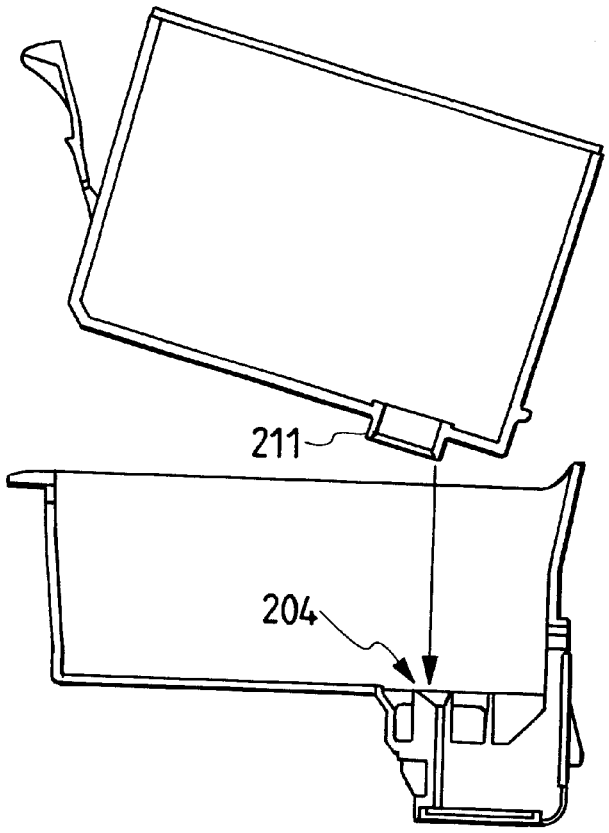
FIGS. 20A and 20B are cross-sectional views which illustrate the state where an ink tank is being mounted on an ink jet head cartridge.
Figure 20B:
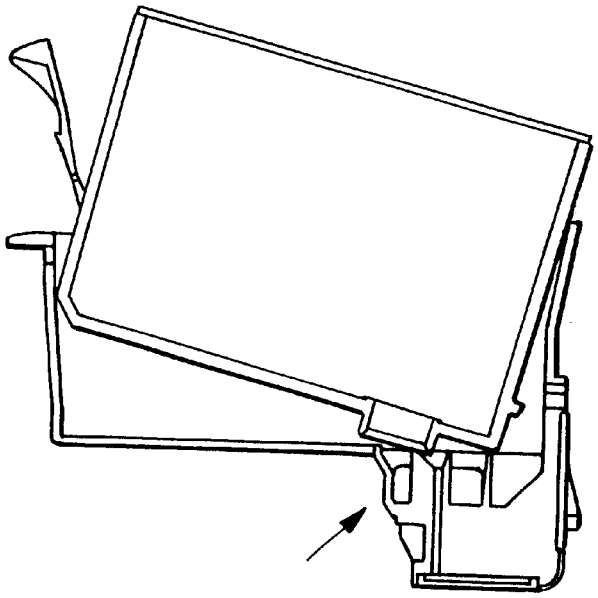

In other words, when the configuration is such that the ink supply opening of the ink tank extrudes outward, the edge of this ink supply opening abuts upon the joint portion as shown in FIGS. 20A and 20B if the ink tank is inserted in a posture in which the ink tank is unnaturally inclined at the time of mounting it. If the ink tank is in contact with the joint portion by a strong force in this state, such portion may be damaged. As a result, there is a fear that ink is not supplied to the head.

The ink tank of the present embodiment is arranged so as not to damage the joint portion of the head cartridge when the ink tank is mounted even if the ink supply opening thereof is configured to protrude outward.

Meanwhile, the ink jet head cartridge houses the ink jet head that discharges ink, and also, through the holding mechanism, the head cartridge detachably houses the ink tanks that retain ink to be supplied to the ink jet head.

Each of the ink tanks comprises the ink supply opening arranged on the bottom thereof; the first nail for fixing the ink tank, which is arranged on the bottom side of the first side; and the second nail arranged to be shiftable by means of a movable lever provided for the second side that faces the first side. Then, the structure is formed so that the third nail is provided above the first nail on the first side in order to regulate the mounting direction.

Now, with reference to FIGS. 11A, 11B, and 11C, the present embodiment will be described in detail.

Figure 11A:
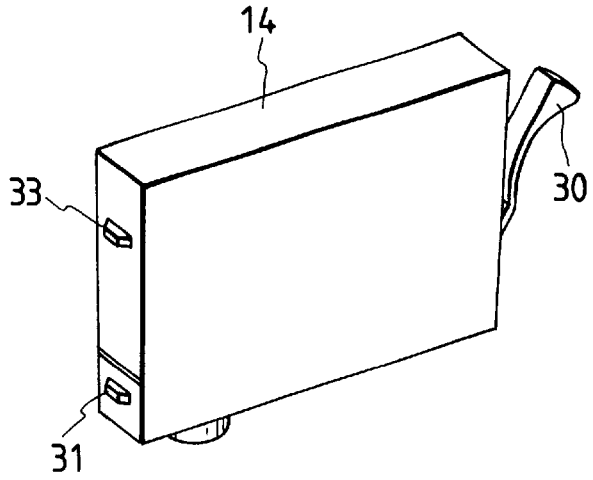
FIGS. 11A and 11B are perspective views which illustrate an ink tank in accordance with a first embodiment of the present invention.
Figure 11B:
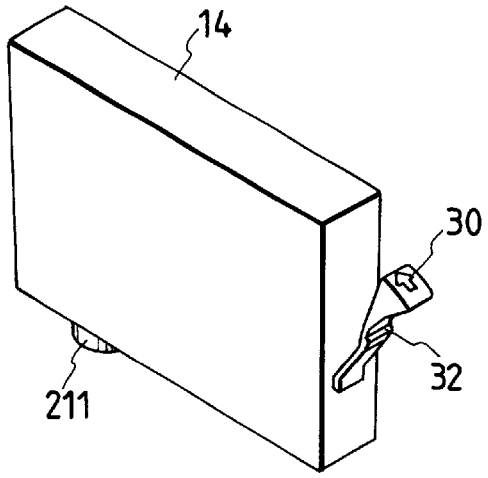

FIGS. 11A and 11B are perspective views showing the ink tank in accordance with the present embodiment. FIG. 11C is a cross-sectional view showing the state where the ink tank is mounted.

Figure 11C:
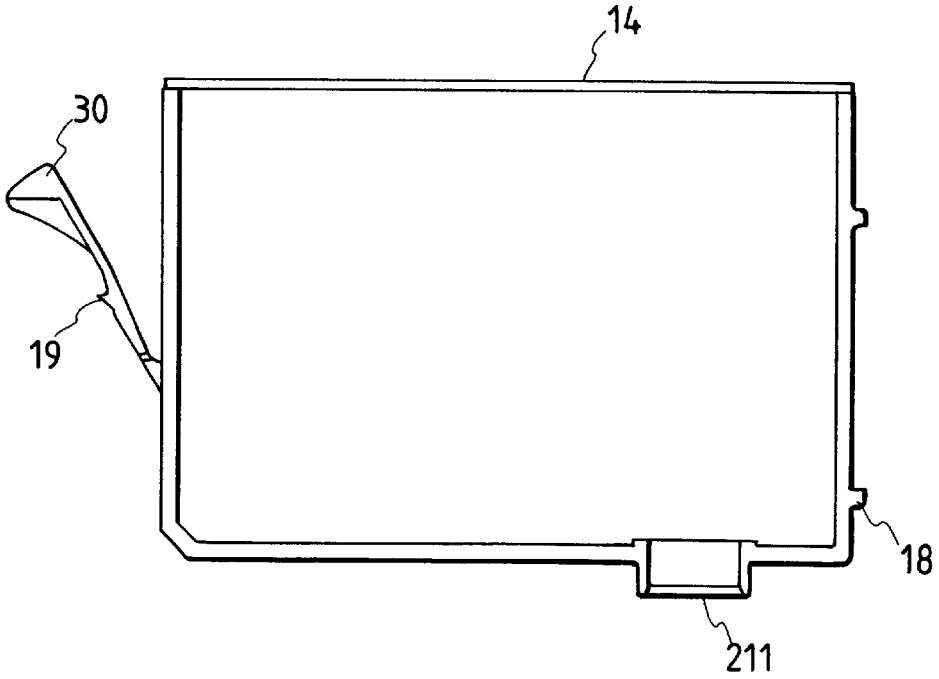
FIG. 11C is a cross-sectional view of this ink tank.
Figure 12A:
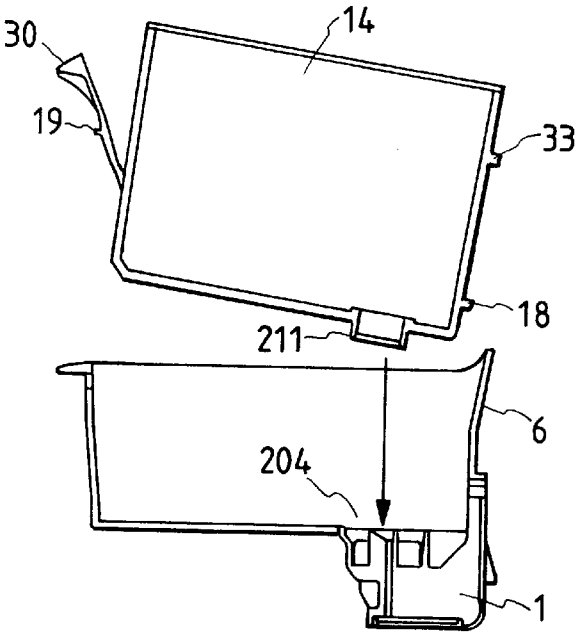
FIGS. 12A, 12B, 12C and 12D are cross-sectional views which illustrate the state where the ink tanks represented in FIGS. 11A, 11B and 11C are being installed.
Figure 12B:
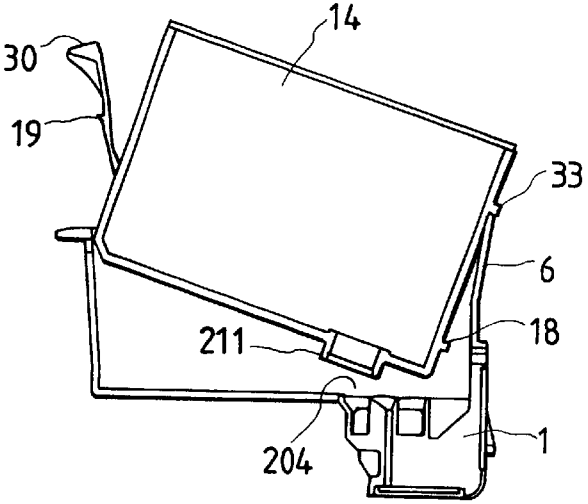
Figure 12C:
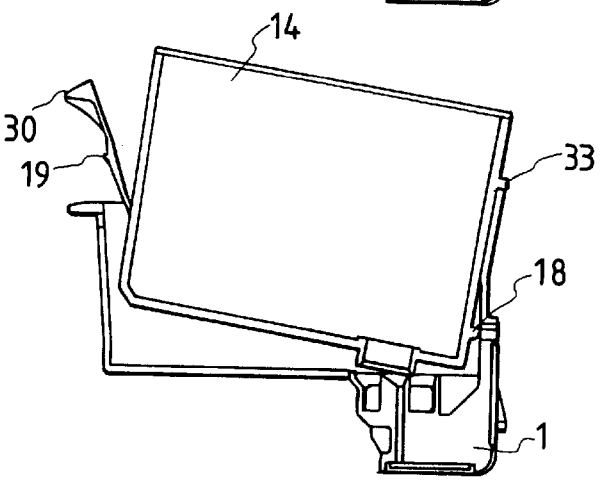
Figure 12D:
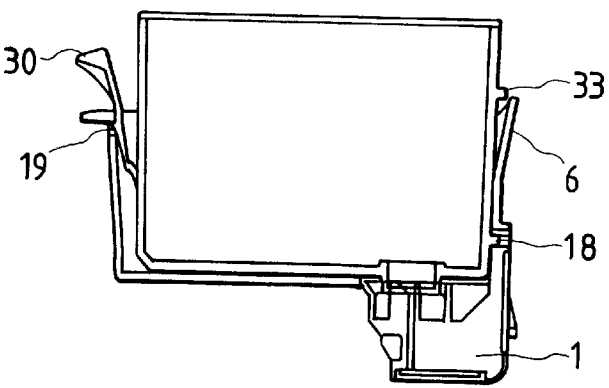

FIGS. 12A, 12B, 12C and 12D are cross-sectional views which illustrate the state where the ink tanks represented in FIGS. 11A, 11B and 11C are being installed.

In FIGS. 11A to 11C, the ink tank 11 is provided with the ink supply opening 211 in a shape that protrudes downward. On the front side of the ink tank in its mounting direction, the first nail 18 is arranged as the ink tank fixing rib that fixes the ink tank to the tank holder. At the same time, the third nail is arranged above the first nail in order to regulate the mounting direction of the ink tank. Further, on the side opposite to the side where these nails are arranged, there is arranged the second nail 19 serving as an ink tank fixing rib, which can turn out from the fixing position by means of the movable lever 30.

On the other hand, for the tank holder 6 of the ink jet head cartridge having the ink tanks 14 mounted thereon, there are arranged the first hole 13*a* for fixing the ink tank, which engages with the first nail 18, and the second hole 13*b* for fixing the ink tank, which engages with the second nail 19. Also, the upper part of the side of the tank holder 6 where the first hole is arranged is inclined outward. The ink tank is guided by means of this inclined portion, and then, the upper end 43 of this inclined portion is formed to be in contact with the third nail of the tank which is inserted slantly.

Now, in conjunction with FIGS. 12A to 12D, the description will be made of the state where the ink tank is being mounted on the tank holder of the ink jet head cartridge.

When the ink tank 14 is put in the holder 6 of the ink jet head cartridge in the normal posture, the ink tank is guided by means of the inclined portion so that the first nail 18 engages with the first hole 13*a*. In this state, the ink tank is pressed in from above. Then, the movable member 30 is caused to bend inward so that the second nail 19 is inserted into the second hole 13*b*, and the ink tank 14 is mounted on and fixed to the ink jet head 1. At this juncture, the third nail 33 is retained in the inner side of the tank holder which is inclined outward.

Also, if the ink tank 14 is mounted on the holder in the inclined posture as shown in FIGS. 12A to 12D, the third nail 33 abuts upon the upper end 43 of the holder before the outer circumference of the ink supply opening 211 is in contact with the joint portion 204 of the head cartridge. Therefore, the outer circumference of the ink supply opening is prevented from abutting upon the joint portion. After that, the ink tank rotates with the third nail as a fulcrum, and when the side of the ink tank is in contact with the inclined portion of the holder, the third nail is caused to part from the upper end of the holder. At the same time, the first nail 18 engages with the first hole 13*a*. In this state, when the ink tank is pressed in from above, the movable lever 30 is caused to bend inward, and the second nail 19 is inserted into the second hole 13*b*. Then, the ink tank 14 is mounted on and fixed to the ink jet head 1. In this way, the normal mounting operation is promoted.

With the operation thus promoted for normal mounting, the ink tanks are coupled with the ink jet head.

Figure 13:
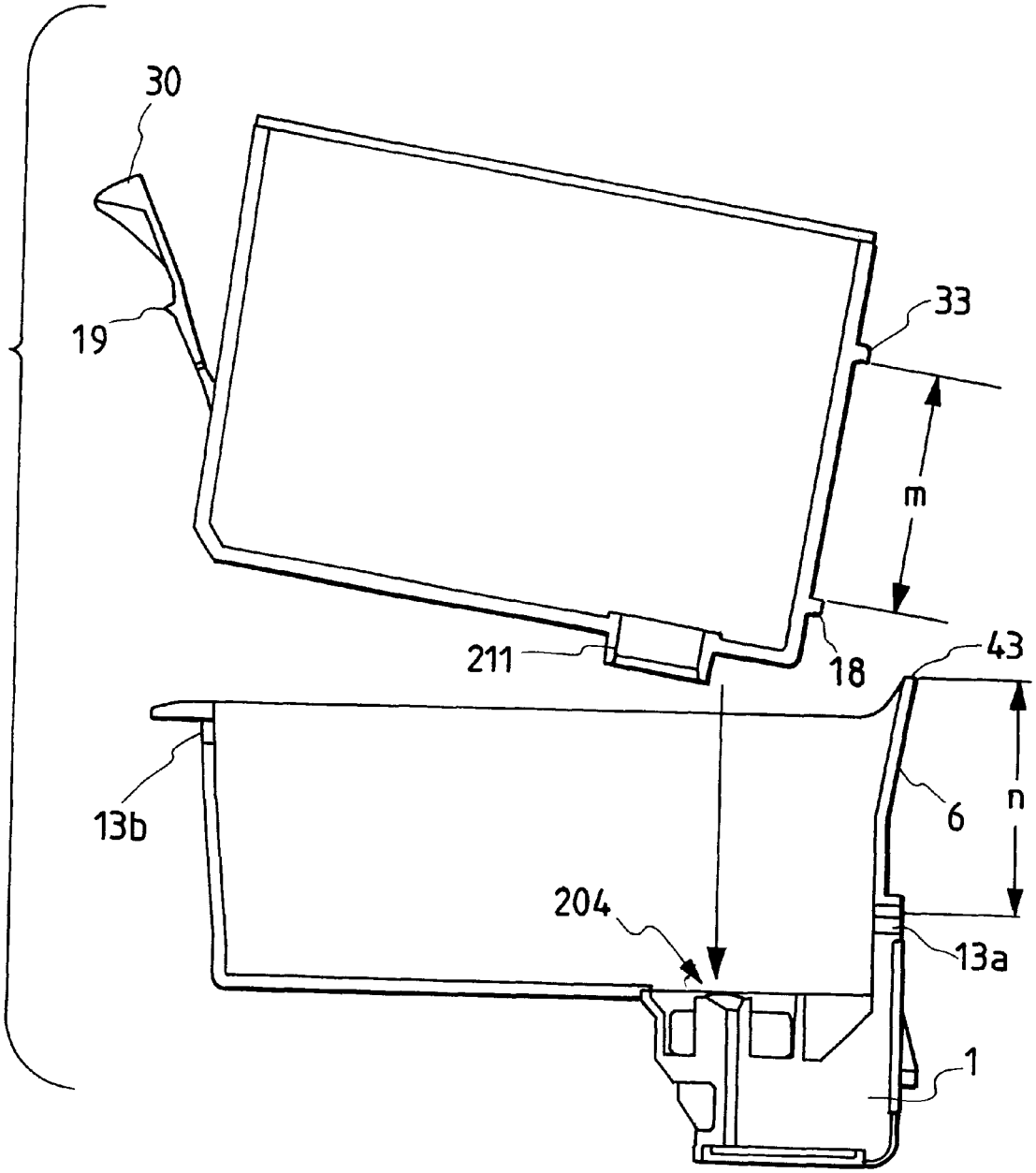
FIG. 13 is a cross-sectional view which shows an ink tank and an ink jet head cartridge.

Here, FIG. 13 is a cross-sectional view which shows the ink tank and the ink jet head cartridge. As shown in FIG. 13, given the distance from the upper end of the first nail 18 to the lower end of the third nail (in the height direction) as m, and the distance from the upper end of the first hole 13*a* of the first hole of the tank holder to the upper end 43 of the side of the holder as n, it is preferable to set the relationship between them as follows:

$$n<m<n+0.5 \text{ mm}$$

The tolerance of this play of 0.5 mm is ± 0.2 mm. Normally, the ink tank cannot be mounted accurately if the play is more or less than this tolerance.

In accordance with the present embodiment, the designed values are: n=39.2 mm and m=39.7 mm.

In this way, the user is able to mount ink tanks smoothly and safely without damaging the joint portion when he replaces ink tanks.

Figure 14:
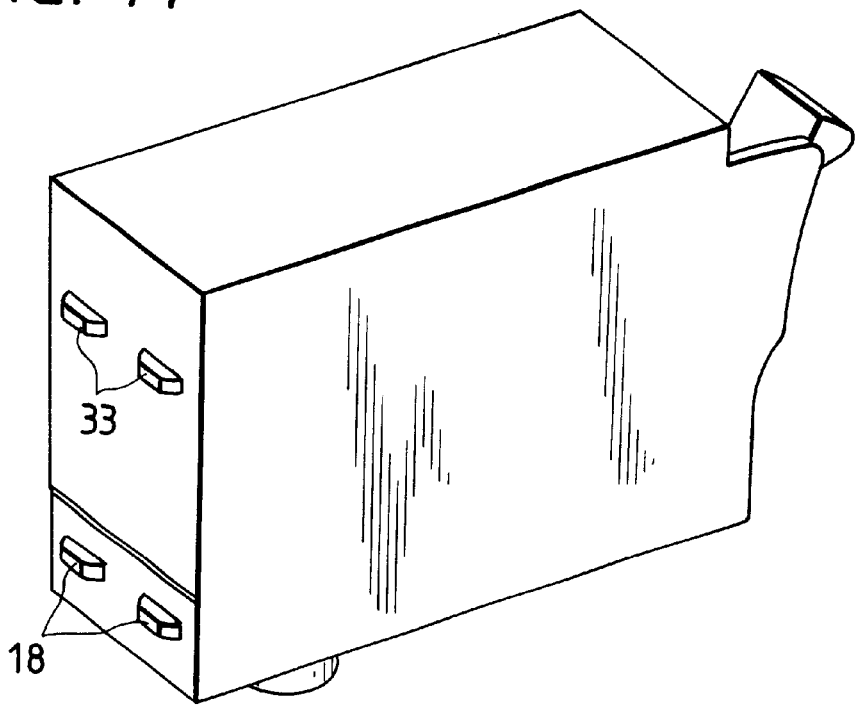
FIG. 14 is a perspective view which shows an ink tank in accordance with a second embodiment of the present invention.
Figure 15:
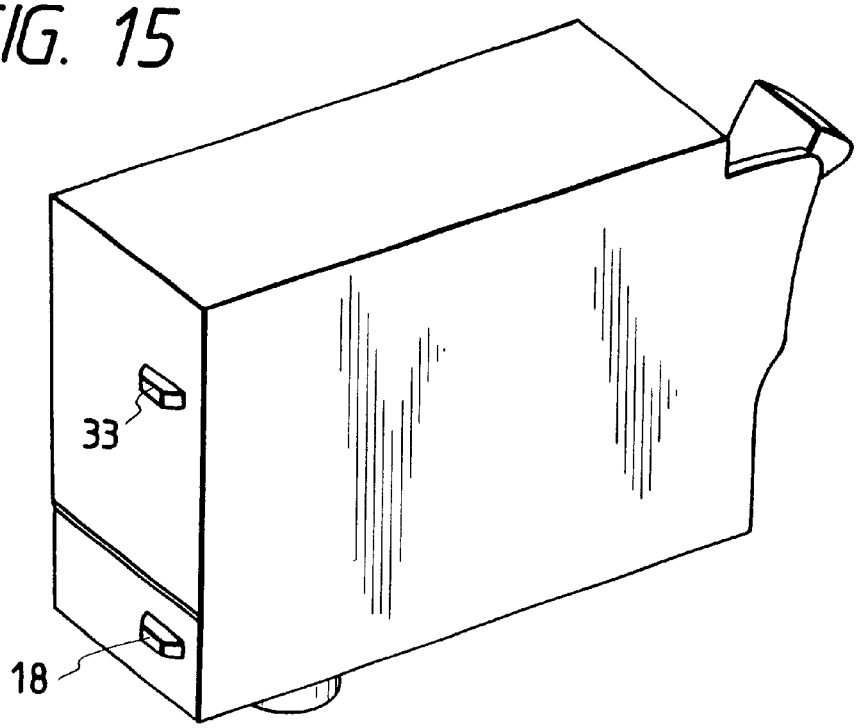
FIG. 15 is a perspective view which shows an ink tank in accordance with a third embodiment of the present invention.

Here, the first nail and the third nail are arranged almost on the central portion of the side of the ink tank. However, it may be possible to arrange them together on one side of the side face of the ink tank as shown in FIG. 15. Also, the nails-may be prepared in plural numbers as shown in FIG. 14. This mode is particularly suitable for a tank having a larger capacity.

Now, the brief description will be made of an ink jet head cartridge mountable on an ink jet head recording apparatus and on a carriage.

Figure 16:
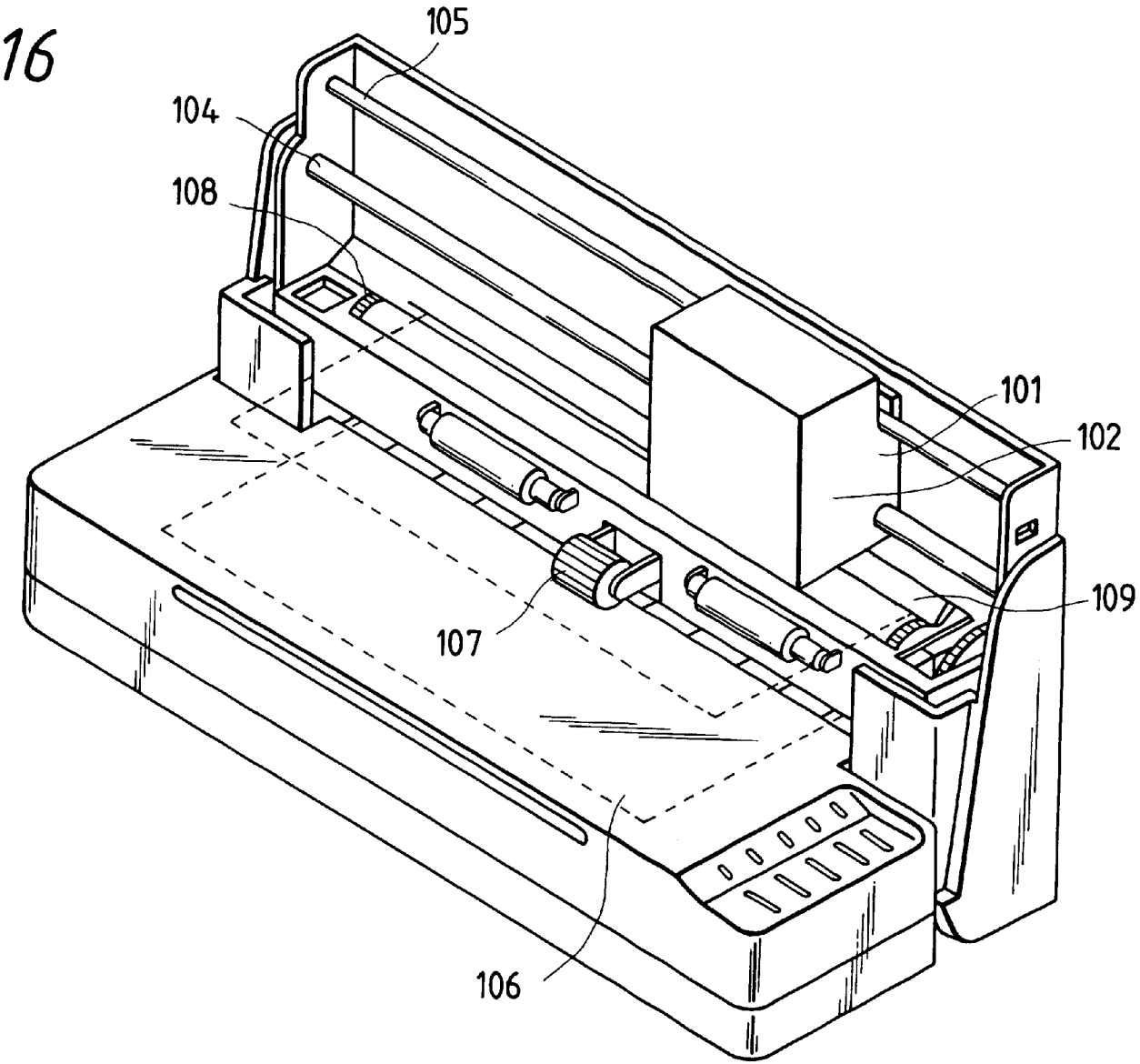
FIG. 16 is a perspective view which shows a color ink jet recording apparatus.
Figure 17B:
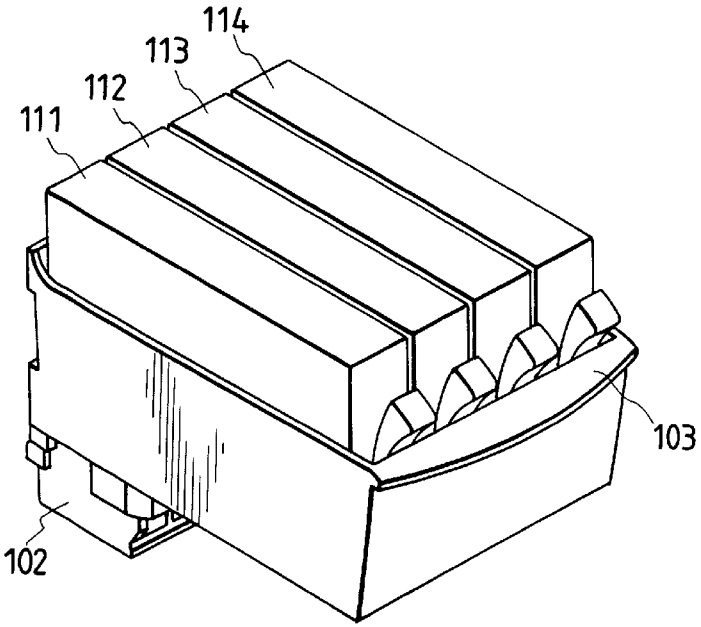
FIGS. 17A and 17B are perspective views which illustrate an ink jet head cartridge.
Figure 17A:
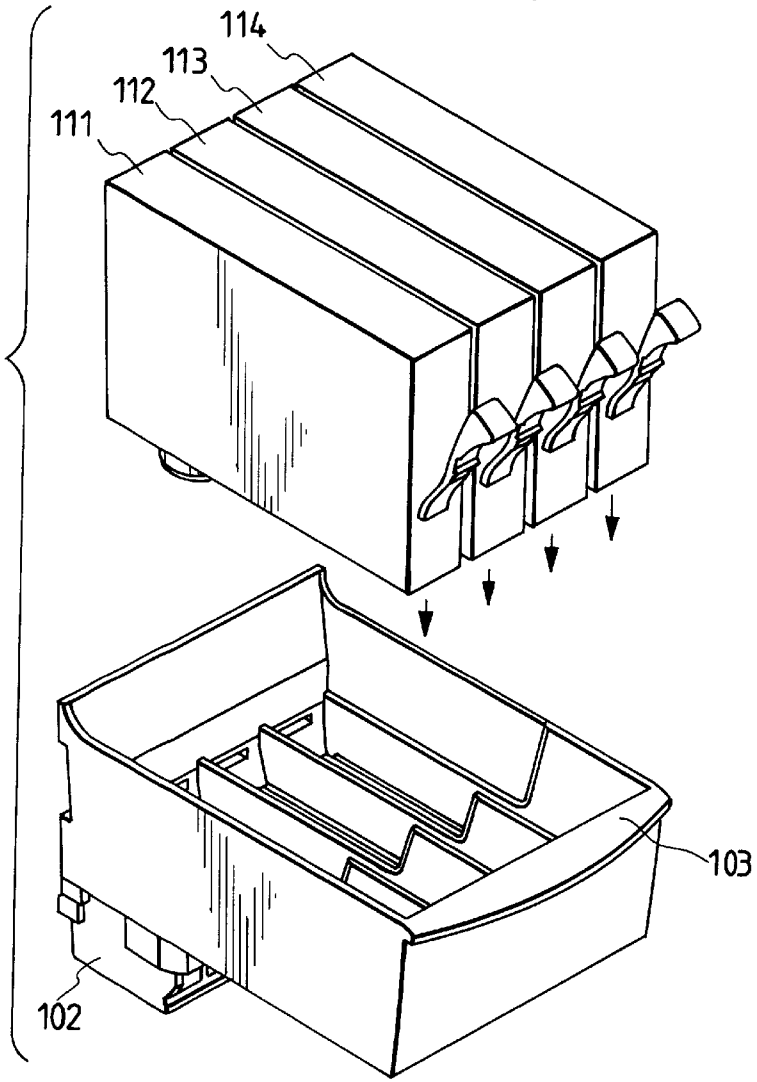
Figure 18A:
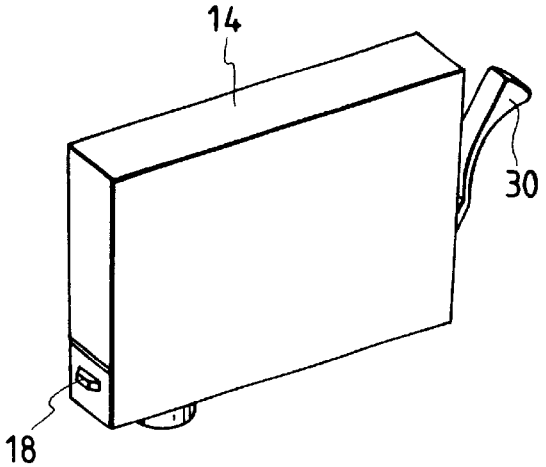
FIGS. 18A and 18B are perspective views which illustrate an ink tank.
Figure 18B:
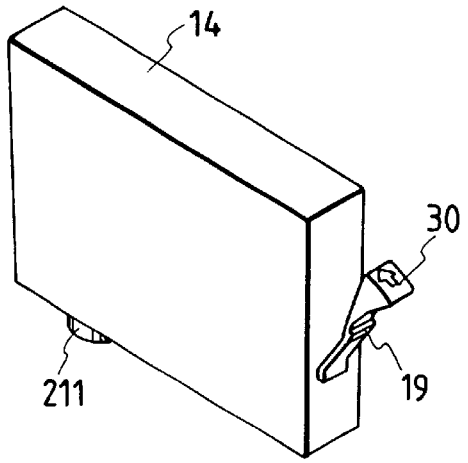
Figure 18C:
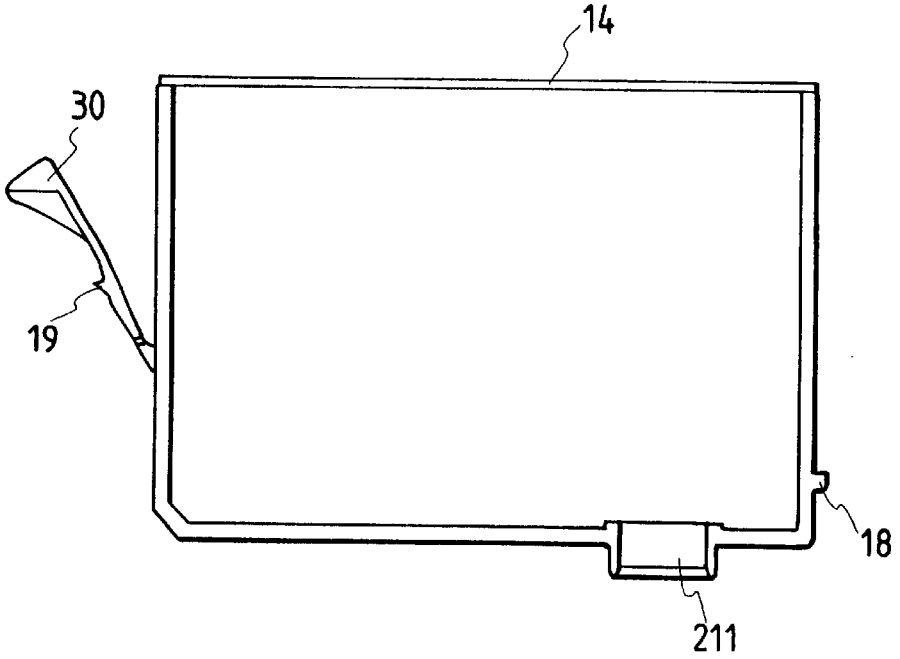
FIG. 18C is a cross-sectional view of this ink tank.
Figure 19A:
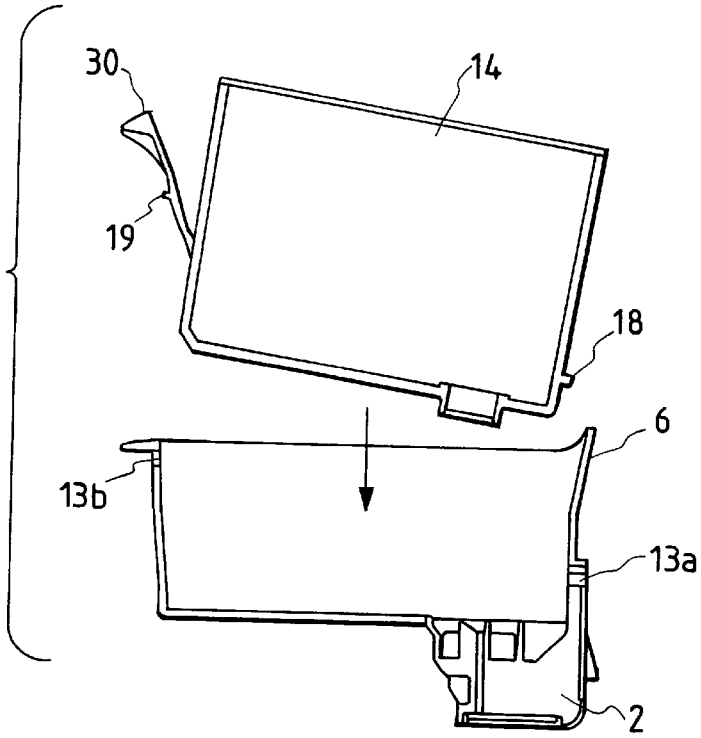
FIGS. 19A, 19B and 19C are cross-sectional views which illustrate the state where an ink tank is being mounted on an ink jet head cartridge.
Figure 19B:
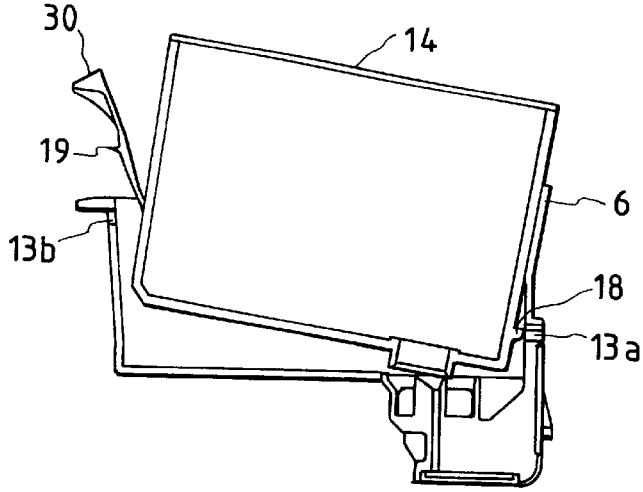
Figure 19C:
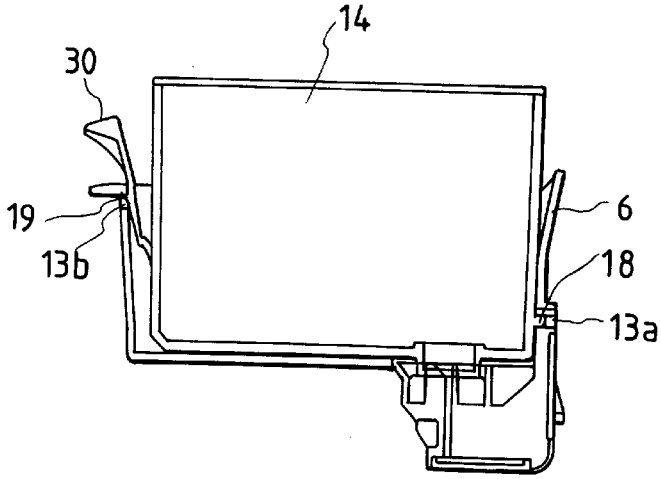

FIG. 16 is a perspective view which shows an ink jet head recording apparatus generally in use. FIGS. 17A and 17B are perspective views which shows an ink jet head cartridge to be mounted in a carriage.

For the ink jet head recording apparatus shown in FIG. 16, the carriage 101 travels on a lead screw 104 and a guide shaft 105 in parallel with them by means of the lead screw 104 interlocked with a carriage motor (not shown).

Also, on the carriage 101, an ink jet head 102 is fixed as shown in FIGS. 17A and 17B. Also, a black ink tank 111, a yellow ink tank 112, a magenta ink tank 113, and a cyan ink tank 114 are detachably mounted along the tank holder 103 to supply ink. FIG. 17A shows the ink jet head cartridge before the ink tank are mounted in the tank holder 103 and FIG. 17B shows the ink jet head cartridge after the ink tanks are mounted in the tank holder 103.

Ink discharged from the ink jet head 102 is shot onto a recording medium serving as a recording sheet 106 for the present embodiment, which faces the ink jet head 102 for the formation of images. While being carried for printing by means of a sheet feed roller 107, a sheet exhaust roller 108, and a sheet pressure plate 109, which are interlocked with a sheet exhaust motor (not shown), the recording sheet 106 is exhausted.

What is claimed is:

1. An ink jet recording head capable of separating or coupling an ink tank from or with said head, comprising:

a recording unit portion for performing ink discharging functions, said recording unit portion including a recording device substrate having a plurality of recording devices for discharging ink, a wiring substrate for providing an externally received electrical recording signal to said recording device substrate, an ink supply member for supplying ink to said recording device substrate and for holding and fixing said recording device substrate and said wiring substrate, an ink supply port and a fixing portion, said ink supply port and said fixing portion being provided to said ink supply member and being used for fixing said ink tank, and a filter member provided on said ink supply port; and a holder member for holding and fixing said ink tank, said holder member being attachably and detachably coupled with said recording unit portion, wherein said holder member does not perform ink discharging functions.

2. An ink jet recording head according to claim 1, wherein said holder member comprises openings for positioning ink tanks, openings for optically reading ink remains in ink tanks, and opening for reading ink remains visually by eyesight.

3. An ink jet recording apparatus comprising:

an ink jet recording head according to claim 1; and a driving mechanism for moving said ink jet recording head.

* * * * *